United States Patent [19]

Harvey

[11] 4,181,382

[45] Jan. 1, 1980

[54] TOWEL-RACK-SUPPORTED SHELF CABINET

[76] Inventor: Louis A. Harvey, 15107 Ilene, Detroit, Mich. 48238

[21] Appl. No.: 890,271

[22] Filed: Mar. 27, 1978

[51] Int. Cl.[2] ..... A47B 97/00

[52] U.S. Cl. ..... 312/245; 108/152; 211/90; 248/214; 248/221.3

[58] Field of Search ..... 312/245, 204, 209; 248/214, 221.3; 108/152; 211/88, 90

[56] References Cited

U.S. PATENT DOCUMENTS

| | | | |
|---|---|---|---|
| 577,204 | 2/1897 | Patten | 312/245 |
| 2,612,273 | 9/1952 | Smith | 248/214 |
| 2,957,587 | 10/1960 | Tobin | 108/152 |

*Primary Examiner*—Mervin Stein
*Assistant Examiner*—Alex Grosz
*Attorney, Agent, or Firm*—Willis Bugbee

[57] ABSTRACT

Releasably attached to the rod of a conventional towel rack by means of a pair of horizontally-spaced wedge-shaped undulating spring brackets is the top shelf of a double-shelf cabinet having end plates depending from the top shelf to a bottom shelf. Extending between the end plates near the forward upper corners thereof is an auxiliary or supplementary towel rod. The cabinet is attached to the rod of a conventional towel rack by lowering the brackets upon it between it and the wall to which the towel rack is attached, the wedge-shaped undulating form of the brackets causing them to snap into fixed recessed positions relatively to the towel rod and to be held therein by the wedging action. Pushing inward on the bottoms of the brackets disengages them from the towel rack whereupon the cabinet may be lifted off the towel rack.

2 Claims, 6 Drawing Figures

FIG. 1
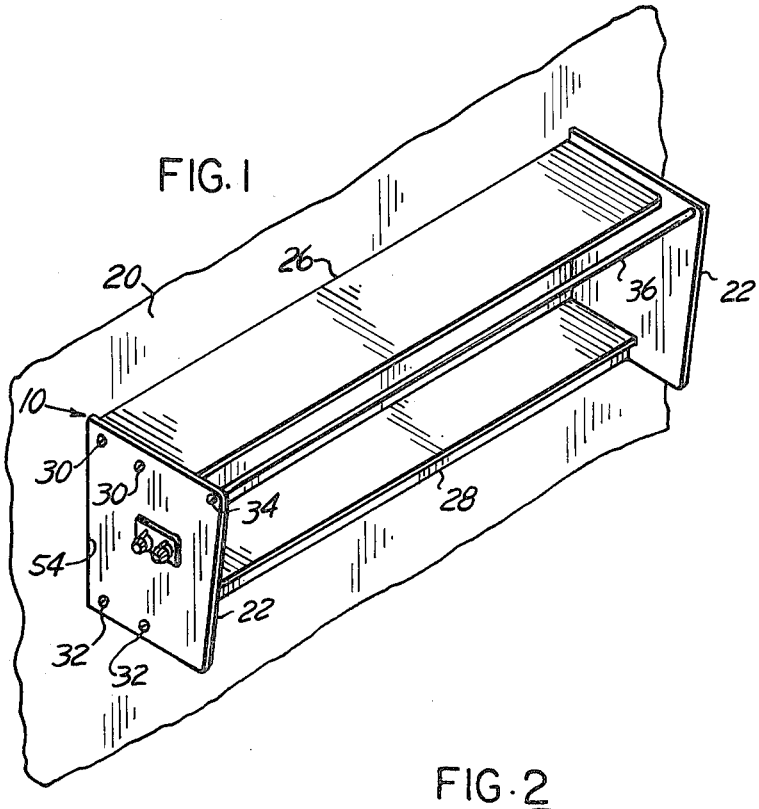
FIG. 2
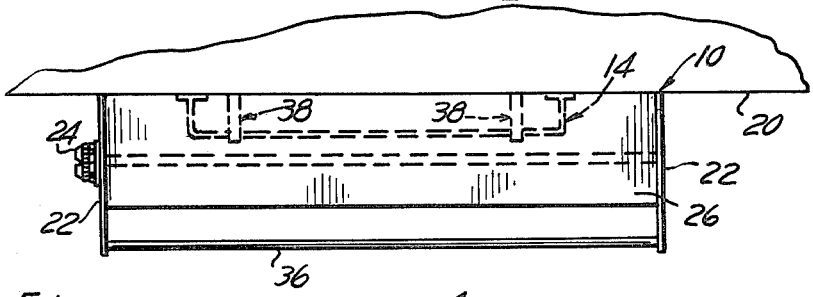
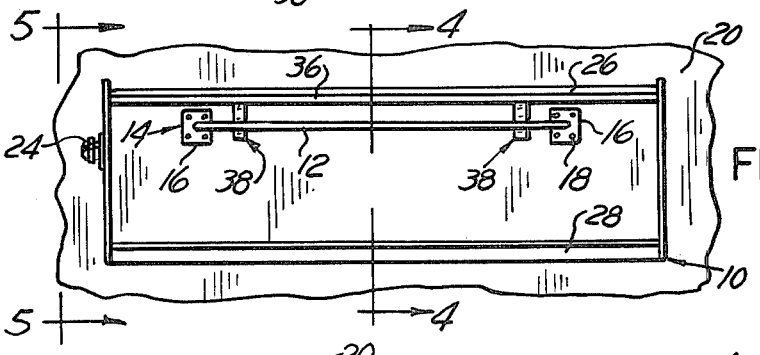
FIG. 3
FIG. 5
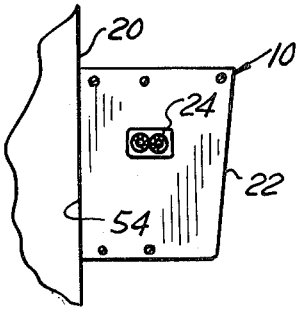
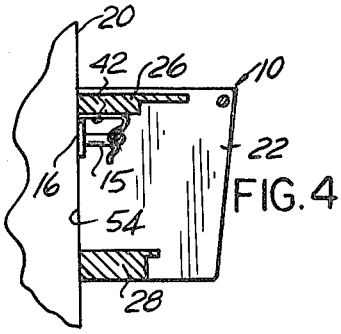
FIG. 4
FIG. 6
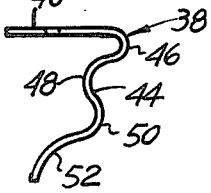

TOWEL-RACK-SUPPORTED SHELF CABINET

SUMMARY OF THE INVENTION

The invention particularly resides in the provision of the double-shelf cabinet with spring brackets enabling it to be quickly and easily attached and detached from the conventional towel rack, thereby supplementing the carrying capacity of the medicine cabinet or other shelf-equipped devices in the bathroom or lavatory. At the same time, the auxiliary towel rod extending across the cabinet between the upper forward corners thereof replaces the already-installed regular towel rack which is being used to support the cabinet. Moreover, the towels hanging from the auxiliary towel rod serve as curtains which tend to conceal the articles on the lower shelf yet are easily pushed aside to gain access to such articles.

In the drawing,

FIG. 1 is a perspective view, upon a reduced scale, of a towel-rack-supported shelf cabinet mounted upon the conventional towel rack (not shown) against a wall;

FIG. 2 is a top plan view of the shelf cabinet shown in FIG. 1, with the supporting towel rack shown in dotted lines;

FIG. 3 is a front elevation of the shelf cabinet shown in FIGS. 1 and 2;

FIG. 4 is a vertical section taken along the line 4—4 in FIG. 3, showing in side elevation one of the attaching brackets;

FIG. 5 is a left-hand end elevation of the shelf cabinet shown in FIGS. 1 to 4 inclusive; and FIG. 6 is an enlarged side elevation of one of the attachment brackets shown in FIGS. 3 and 4 by which the cabinet is attached to the regular towel rack.

Referring to the drawing in detail, FIG. 1 shows a towel-rack-supported shelf cabinet, generally designated 10, as mounted on and supported by the cross rod 12 of a conventional towel rack 14 which has the usual bent end portions 15 secured to attachment plates 16 attached by screws, bolts or other fasteners 18 to a wall of a room 20, usually a lavatory or bathroom wall. The cabinet 10 consists of a pair of spaced parallel end plates 22 to one of which is secured a toothbrush holder 24. Extending between the end walls of plates 22 are upper and lower shelves 26 and 28 respectively. Upper and lower pairs of screws 30 and 32 respectively secure the end walls 22 to the shelves 26 and 28. Screws 34 threaded into the opposite ends of an auxiliary or supplementary towel rod 36 hold the latter so as to receive the towels ordinarily carried by the towel rack 12 but displaced therefrom by the mounting thereon of the cabinet 10. Secured to the under side of the upper shelf 26 in spaced parallel relationship to one another are two approximately wedge-shaped spring brackets 38 shaped approximately like the numeral 7 and shown enlarged in FIG. 6. Each bracket 38 is preferably formed of spring steel and has an upper arm portion 40 attached by screws 42 to the under side of the upper shelf 26 (FIG. 4) and an undulating inclined arm portion 44 disposed at an acute angle of approximately sixty degrees to the upper arm portion 40 and provided with bends 46, 48 and 50 and terminating in a relatively straight lower end portion 52. The brackets 38 are attached to the upper shelf 26 in such locations that the vertical rearward edges 54 of the approximately rectangular end plates flatly engage the room wall 20 when the cabinet is installed on the towel rack 14 and maintain the shelves 26 and 28 horizontal.

To attach the cabinet 10 to the conventional towel rack 14, any towels already thereon are first removed and transferred to the auxiliary towel rod 36. The installer then raises the cabinet 10 above the towel rack 14 between its end plates 16 and lowers the cabinet 10 upon the towel rack 14 in such a manner that the lower ends 52 of the spring brackets 38 move inside the towel rack 14 between the cross rod 12 thereof and the wall 20, whereupon the undulating lower arms 44 bend relatively to the upper arms 40 until one of the concave undulations of each bracket 38 snaps into place behind the cross rod 12 of the towel rack 14.

Any desired articles can then be placed upon either or both of the upper and lower shelves 26 and 28, those articles on the lower shelf 28 being ordinarily concealed by the towels upon the auxiliary towel rod 36. The inclined arm portions 44 adapt the cabinet 10 to fit the cross rods 12 on different lengths of end portions 15 by wedging into the varying spaces between the cross rod 12 and the room wall 20 to which the towel rack 14 is attached. The invention thus provides considerable additional shelf space for articles which ordinarily cannot be accommodated in the relatively small medicine cabinets usually provided in bathrooms or lavatories. If it is desired to increase the load-carrying capacity of the regular towel rack 14, the attachment plates 16 may be secured to the wall 20 by conventional expansion bolts as the fasteners 18. The load imposed on the rod 12 of the regular towel rack 14 may also be decreased by the use of thin light-weight materials for the shelf cabinet 10.

In the accompanying claims, the words "horizontally-spaced" or "vertically-spaced" are concise expressions which will be understood to mean "spaced apart from one another in a horizontal direction" or "spaced apart from one another in a vertical direction" respectively.

I claim:

1. A shelf cabinet adapted to be suspendedly supported by a conventional towel rack attached to the wall of a room, said cabinet comprising a pair of cabinet end plates disposed in horizontally-spaced relationship, upper and lower horizontal shelves disposed in vertically-spaced parallel relationship and secured at their opposite ends to said end plates, and a plurality of cabinet-supporting brackets secured to said upper shelf and extending rearwardly thereon and adapted to supportingly engage the conventional wall-attached towel rack in supported relationship therewith, said brackets being formed of resilient material in the approximate shape of the numeral seven, the inclined forward portions of the numeral-seven-shaped brackets being of undulating form with alternating projections and towel-rack-rod fitting recesses therealong, the upper portions of the numeral-seven-shaped brackets being secured to the under side of said upper shelf.

2. A towel-rack-supported shelf cabinet, according to claim 1, wherein an auxiliary towel rod extends between said end plates with its opposite ends secured thereto, said auxiliary towel rod being secured to and extending between the upper forward portions of said end plates.

* * * * *